US011382818B2

(12) United States Patent
Zhou

(10) Patent No.: US 11,382,818 B2
(45) Date of Patent: Jul. 12, 2022

(54) BODY STRETCHER

(71) Applicant: Xiamen Zhoulong Sporting Goods Co., Ltd., Xiamen (CN)

(72) Inventor: Yuzhi Zhou, Xiamen (CN)

(73) Assignee: XIAMEN ZHOULONG SPORTING GOODS CO., LTD., Xiamen (CN)

( * ) Notice: Subject to any disclaimer, the term of this patent is extended or adjusted under 35 U.S.C. 154(b) by 730 days.

(21) Appl. No.: 16/401,778

(22) Filed: May 2, 2019

(65) Prior Publication Data

US 2020/0069503 A1 Mar. 5, 2020

(30) Foreign Application Priority Data

Sep. 4, 2018 (CN) ..... 201821436291.9

(51) Int. Cl.
*A61H 1/02* (2006.01)

(52) U.S. Cl.
CPC ... *A61H 1/0222* (2013.01); *A61H 2201/1607* (2013.01); *A61H 2201/1638* (2013.01); *A61H 2201/1642* (2013.01); *A61H 2201/1671* (2013.01)

(58) Field of Classification Search
CPC ..... A61H 1/0222; A61H 2201/1607; A61H 2201/1638; A61H 2201/1642; A61H 2201/1671; A61H 1/0218; A61F 5/04; A61F 5/048; A61F 5/042; A61F 5/026; A61F 13/041; A61F 5/01; A61F 5/05; A61F 2013/0028; A61F 5/0102; A61F 5/37; A61F 5/3761; A61G 13/0036; A61G 13/129; A61G 13/04; A61G 13/08; A61G 13/126; A61G 2210/50; A61G 13/1295; A61G 7/10; A61G 2200/325; A61G 7/0755; A61G 13/0018; A61G 13/0081; A61G 13/02; A61G 13/1215; A61G 15/007; A61G 15/125; A61G 7/075; A61G 13/00; A61G 13/0054; A61G 13/104; A61G 13/12; A61G 13/1205; A61G 13/128; A61G 15/005; A61G 1/04; A61G 2200/32; A61G 5/12; A61G 5/122; A61G 5/127; A61G 7/015; A61G 7/018; A61G 7/08; A61G 7/1013; A61G 2203/32; A61G 15/00; A61G 13/123; A61G 13/1245; A61G 2200/322; A47B 7/00; A47C 17/86; A61B 2017/564
See application file for complete search history.

(56) References Cited

FOREIGN PATENT DOCUMENTS

CN 202070085 U 12/2011

*Primary Examiner* — Ophelia A Hawthorne
(74) *Attorney, Agent, or Firm* — Muncy, Geissler, Olds & Lowe, P.C.

(57) ABSTRACT

A body stretcher includes a floor-standing frame, wherein a horizontal plate is connected to an upper surface, with a sleeve tube, pulleys are mounted on a headrest, one end of the movable rod is connected with a foot hook frame, an end, inserted into the sleeve tube, of the movable rod is connected with a rack, an elastic rope winds across the pulleys to be connected with a head protector; a support is arranged on the outer side of the sleeve tube, one end of a manual swing rod is hinged to the support, an active pawl is hinged to the manual swing rod, one end of the active pawl is matched with a toothed groove of the gear, a check pawl is hinged to the support, and a compression spring drives one end of the check pawl to be matched with the toothed groove of the gear.

18 Claims, 6 Drawing Sheets

BODY STRETCHER

BACKGROUND OF THE INVENTION

1. Technical Field

The invention relates to the technical field of the manufacturing of fitness equipment, in particular to a body stretcher.

2. Description of Related Art

In today's information era, many people are suffering from cervical spondylosis and lumbar spondylosis due to frequent use of mobile phones and long-term use of computers by office workers. Body stretching is an effective way to prevent cervical spondylosis and lumbar spondylosis. The applicant has put forward a stretcher in Chinese Utility Model Patent No. ZL201120160925.4 disclosed on Dec. 11, 2011. This stretcher, used for body stretching, can stretch the lumbar vertebra and legs only, but cannot stretch the whole body. Particularly, this stretcher cannot stretch the cervical vertebra and the lumbar vertebra at the same time.

BRIEF SUMMARY OF THE INVENTION

The technical issue to be settled by the invention is to provide a body stretcher which is able to stretch the whole body of people and particularly is able to stretch the cervical vertebra and lumbar vertebra of the body at the same time.

The technical solution adopted by the invention to fulfill the above objective is as follows: a body stretcher comprises a floor-standing frame, wherein a horizontal plate is fixedly connected to the upper surface of the floor-standing frame. The body stretcher is characterized in that a sleeve tube is arranged on the floor-standing frame, one end of the sleeve tube is connected with a headrest, a plurality of pulleys are mounted on the headrest, a movable rod is inserted into the other end of the sleeve tube, an end, away from the sleeve tube, of the movable rod is fixedly connected with a foot hook frame, an end, inserted into the sleeve tube, of the movable rod is fixedly connected with a rack, and an elastic rope has an end connected with one end of the rack or the end, inserted into the sleeve tube, of the movable rod as well as an end winding across the plurality of pulleys to be connected with a head protector.

A support is fixedly arranged on the outer side of the sleeve tube. A receding through hole is formed in a position, corresponding to the support, of the outer side of the sleeve tube. A gear is mounted on the support and is engaged with the rack through the receding through hole. One end of a manual swing rod is hinged to the support. An active pawl is hinged to the manual swing rod and is close to the gear. One end of the active pawl is matched with a toothed groove of the gear. A check pawl is hinged to the support. A compression spring is mounted between the check pawl and the support and drives one end of the check pawl to be matched with the toothed groove of the gear. The manual swing rod can be swung to drive the gear to rotate through the active pawl or can be pushed to drive the active pawl and the check pawl to be separated from the gear.

Furthermore, two sides of the sleeve tube are each provided with a hinge base which is close to the headrest and is hinged to one end of a hand rest supporting rod. The other end of each hand rest supporting rod is fixedly connected with a hand rest rod which is sleeved with a protective jacket. The hand rest rods are perpendicular to the hand rest supporting rods. Users can have their left hand and right hand leaning against the two hand rest rods to exert strength and can also independently stretch and exercise the lumbar vertebra through the two hand rest rods.

Furthermore, one end of the manual swing rod is fixedly connected with a U-shaped base. A first connecting pin and a second connecting pin are mounted on the support. The gear and the U-shaped base are pivoted on the first connecting pin. The gear is located in the middle of the U-shaped base. The check pawl is pivoted on the second connecting pin. A third connecting pin is mounted on the U-shaped base. The active pawl is pivoted on the third connecting pin and is located in the middle of the U-shaped base. The third connecting pin is sleeved with a torsion spring. One end of the torsion spring leans against the U-shaped base, and the other end of the torsion spring presses against the active pawl to enable one end of the active pawl to be matched with the toothed groove of the gear. The first connecting pin, the second connecting pin, and the third connecting pin are arranged in parallel.

Preferably, the headrest is in an L shape. One end of the headrest is inserted in an inner hole in one end of the sleeve tube and is fixedly connected with the inner hole through a lock bolt. The number of the pulleys is two, and the two pulleys are respectively mounted at two ends of the headrest.

Furthermore, a plurality of positioning holes are formed in the end, inserted into the sleeve tube, of the headrest at intervals, and when the relative positions of the headrest and the sleeve tube are adjusted, the lock bolt is matched with one of the plurality of positioning holes. In this way, the relative positions of the headrest and the sleeve tube can be adjusted to adapt to users of different heights.

Preferably, the foot hook frame comprises a vertical rod and two cross rods fixedly connected to each of two sides of the vertical rod, wherein each cross rod is sleeved with a protective jacket, the lower portion of the vertical rod is fixedly connected with one end of the movable rod, and wheels are respectively mounted on two sides of the lower end of the vertical rod.

Preferably, the vertical rod comprises a lower vertical rod and an upper vertical rod, wherein the lower vertical rod is fixedly connected with one end of the movable rod, the upper vertical rod is telescopically inserted into the lower vertical rod and is fixedly connected with the lower vertical rod, two sides of the lower vertical rod are each fixedly connected with one cross rod, and two sides of the upper vertical rod are each fixedly connected with one cross rod. In this way, the distance between the two upper cross rods and the two lower cross rods can be adjusted so as to meet the usage requirements of different users.

Furthermore, a foot support frame is fixedly connected to the upper portion of a side, close to the foot hook frame, of the floor-standing frame and is provided with a plurality of horizontal support rods. Two sides of each horizontal support rod are each provided with a protective jacket. The two protective jackets on each horizontal support rod are connected through a clamping piece. In this way, users can use the body stretcher more comfortably.

Furthermore, the movable rod comprises a front movable rod and a rear movable rod, wherein the front movable rod is inserted into an inner hole of the sleeve tube, the rack is fixedly connected to the front movable rod, the rear movable rod is telescopically inserted into the front movable rod, and the front movable rod and the rear movable rod are fixedly connected through a lock bolt.

Furthermore, a limiting pin is fixedly connected to the rack, a long strip-shaped limiting through hole is formed in one side of the sleeve tube, and the limiting pin is matched with the limiting through hole to restrain the moving position of the movable rod.

The head protector is connected with the movable rod through the elastic rope, and the movable rod is fixedly connected with the foot hook frame, so that the head protector and the foot hook frame can move relatively. When a user puts on the head protector on the head and has both foot soles crooked on the foot hook frame, the user swings the manual swing rod, which in turn drives the gear to rotate through the active pawl, and afterwards, the gear drives the rack, the movable rod and the foot hook frame to stretch the whole body, and the oppressed cervical vertebra and lumbar vertebra of the body can be stretched and exercised at the same time so as to be relaxed. The body stretcher can also be used by patients, suffering from cervical spondylosis and lumbar spondylosis, for rehabilitation training. Moreover, through the two hand rest rods, the body stretcher can also be used for stretching and exercising the lumbar vertebra independently.

DETAILED DESCRIPTION OF THE INVENTION

Figure 1:
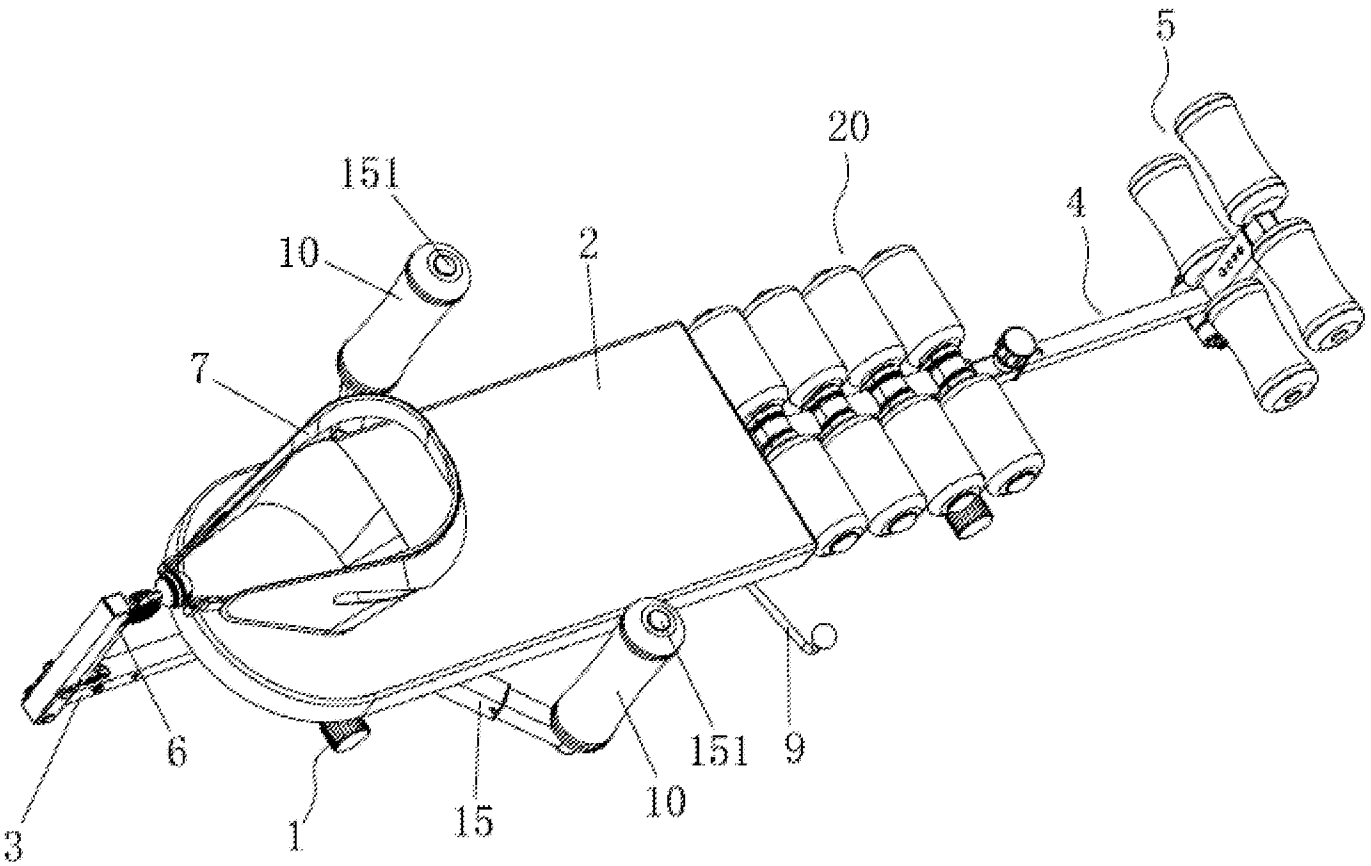
FIG. 1 is a top perspective view of the invention.
Figure 2:
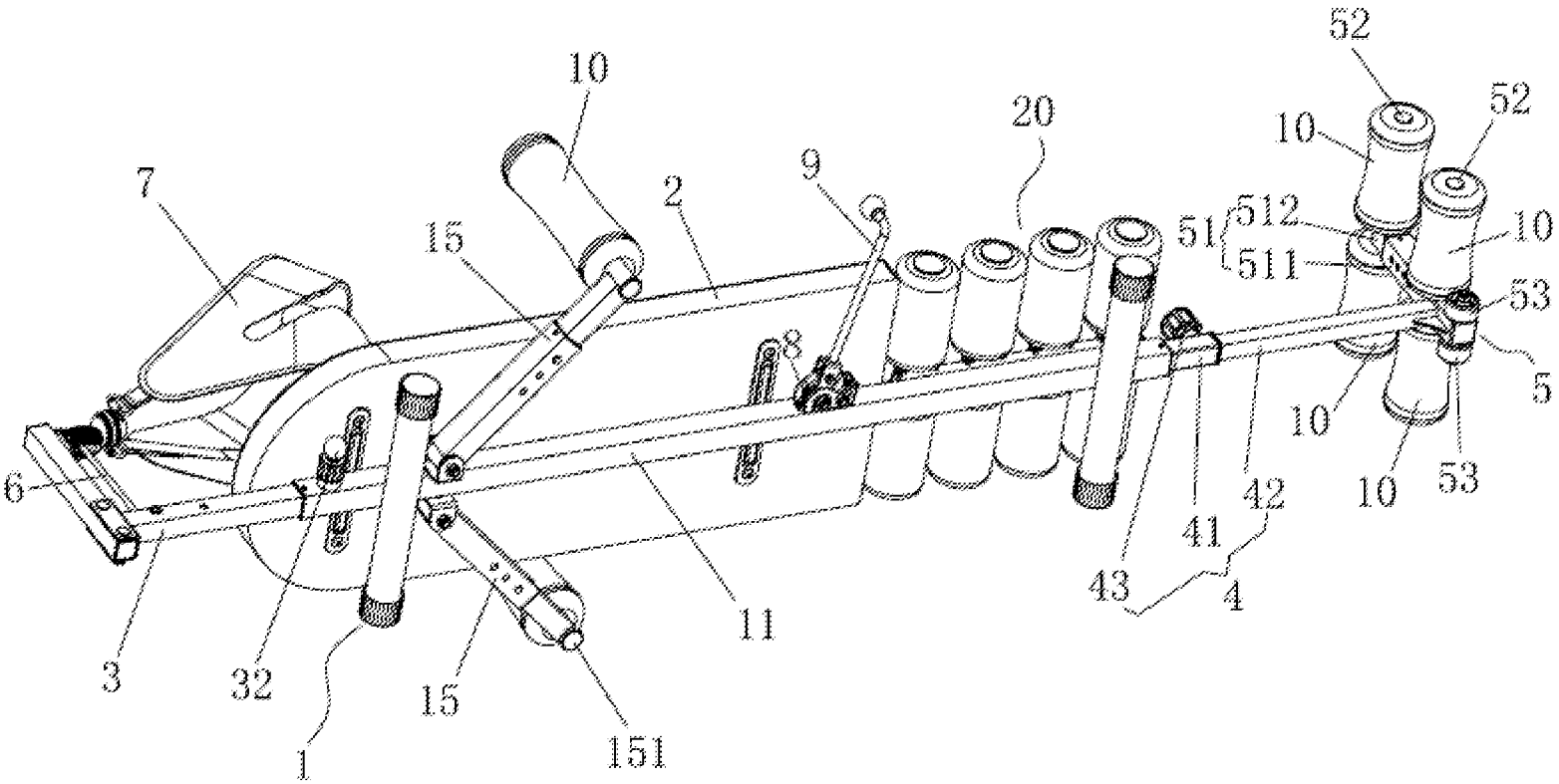
FIG. 2 is a bottom perspective view of the invention.
Figure 3:
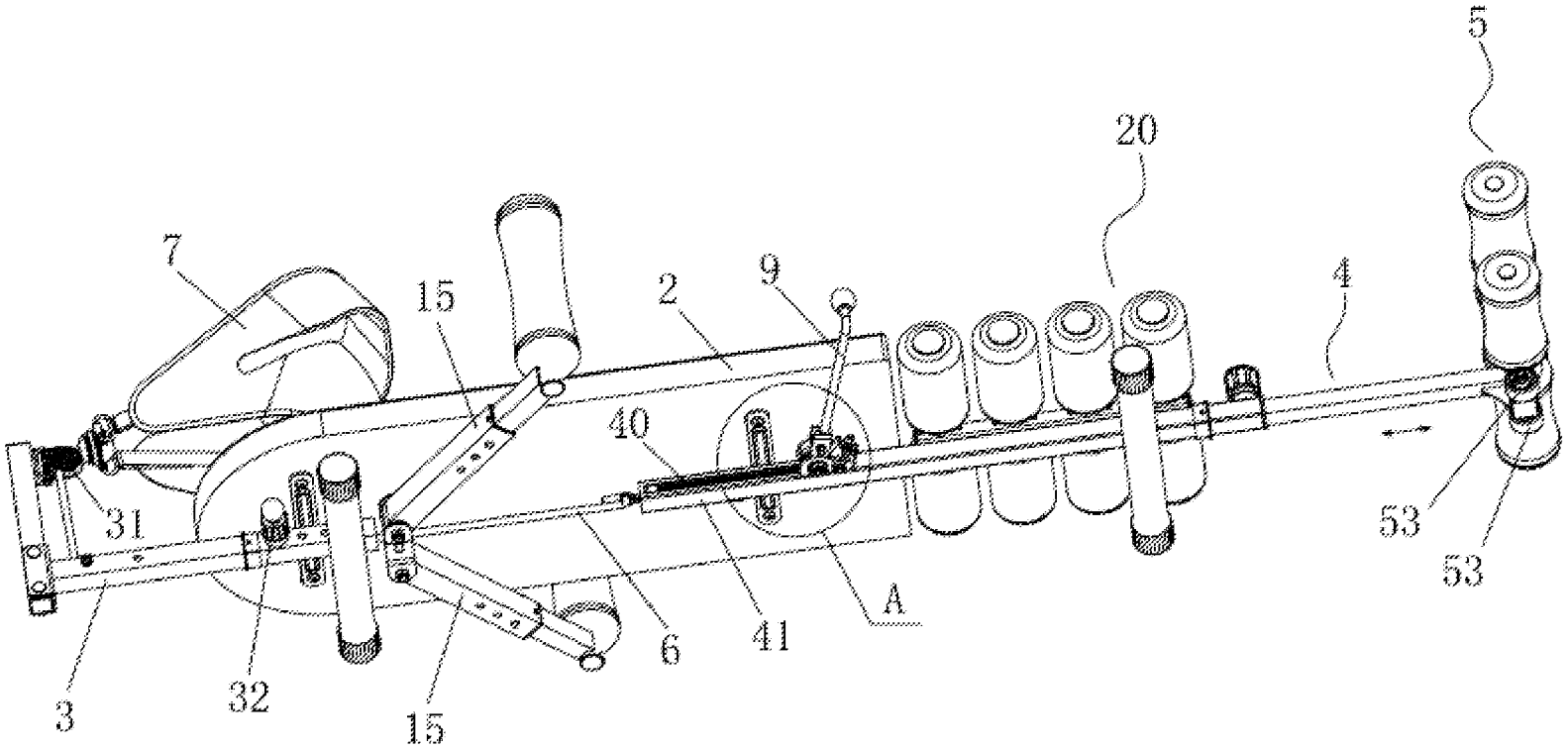
FIG. 3 is a bottom perspective view of a hidden sleeve tube of the invention.
Figure 4:
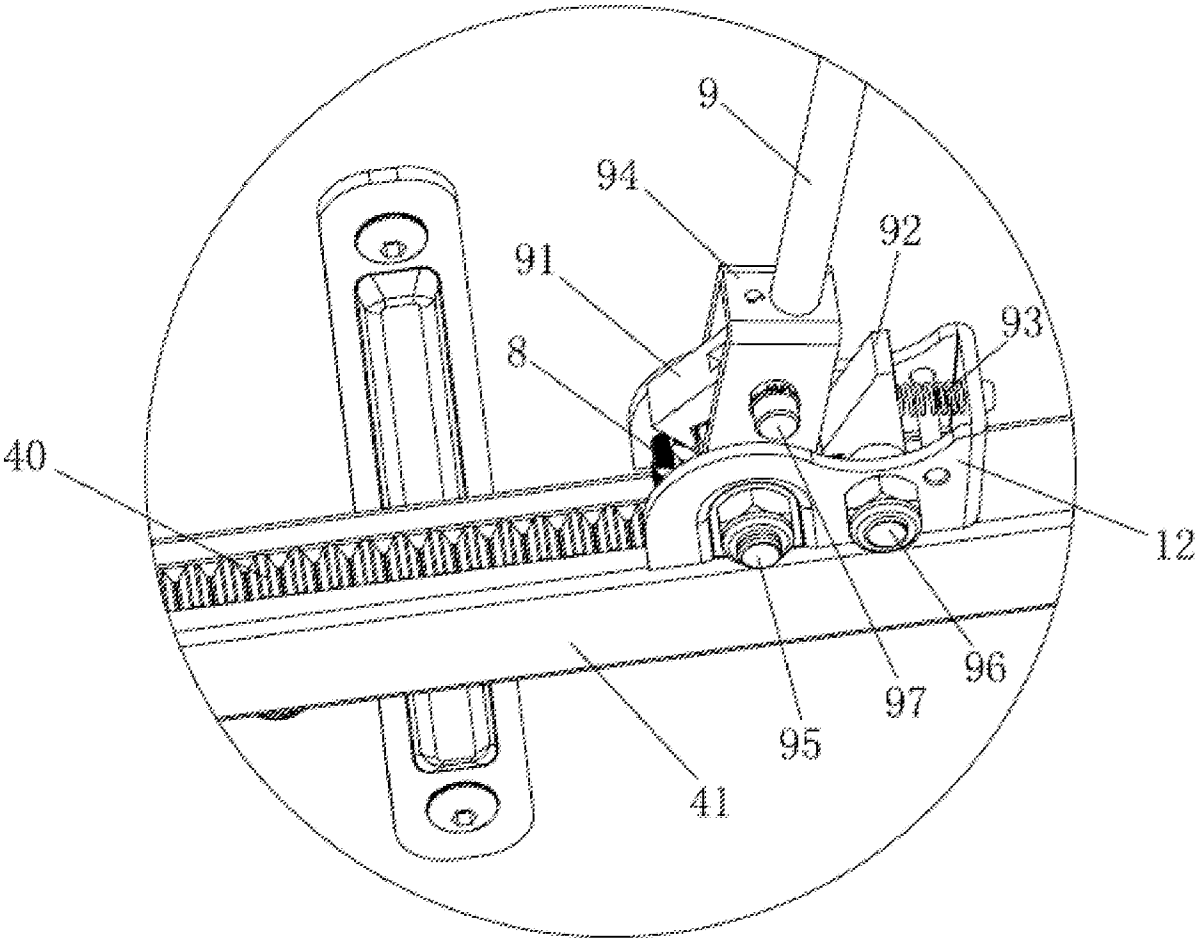
FIG. 4 is an enlarged view of part A in FIG. 3.
Figure 5:
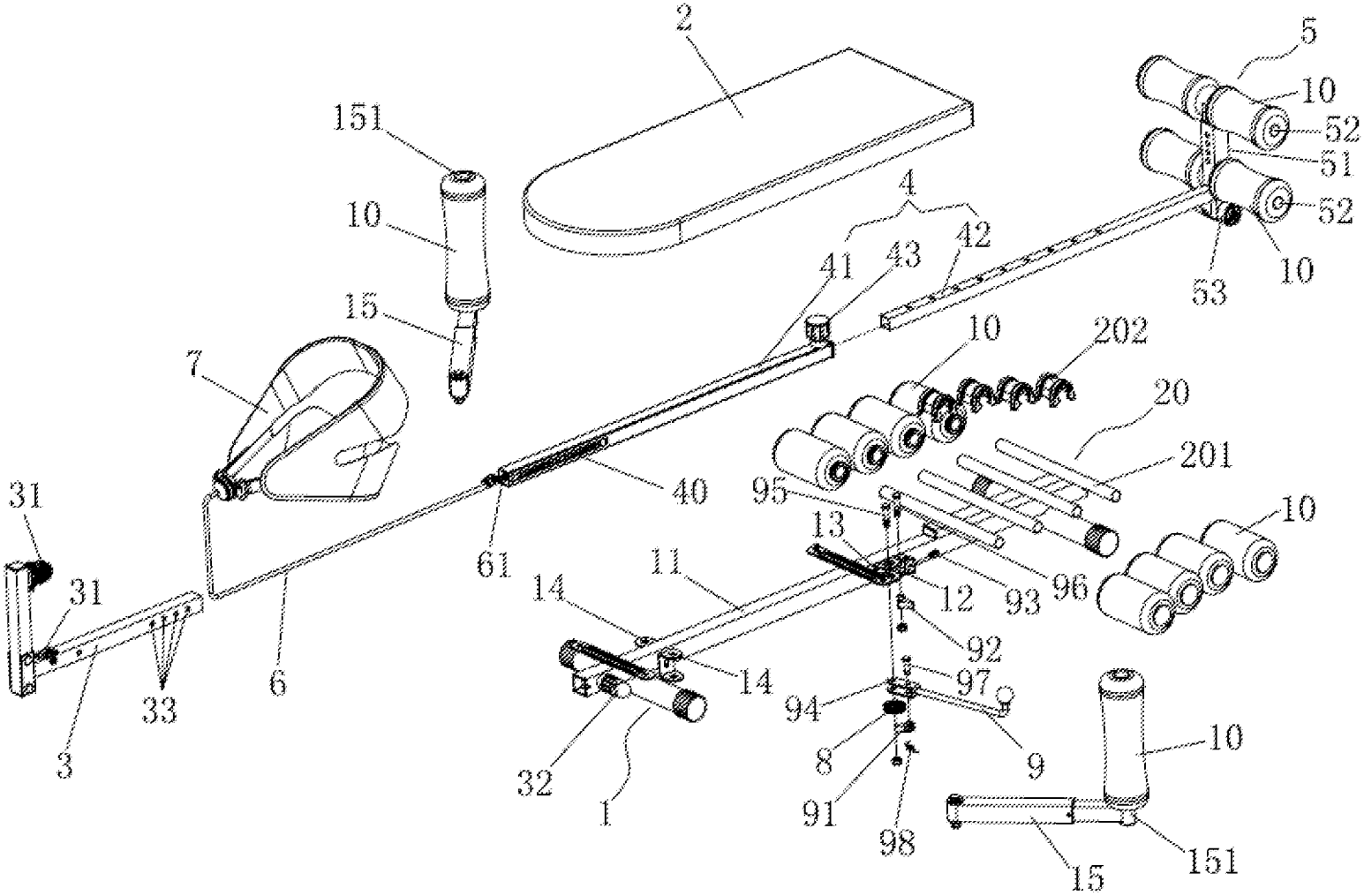
FIG. 5 is an exploded perspective view of the invention.

The invention is further detailed below in combination with the accompanying drawings and specific embodiments.

As shown in FIGS. 1-6, a body stretcher comprises a floor-standing frame 1. A horizontal plate 2 is fixedly connected to the upper surface of the floor-standing frame 1. A sleeve tube 11 is arranged on the floor-standing frame 1 and is distributed in a length direction of the horizontal plate 2. One end of the sleeve tube 11 is connected with a headrest 3. The headrest 3 is provided with two pulleys 31 and is in an L shape. One end of the headrest 3 is inserted into an inner hole in one end of the sleeve tube 11 and is fixedly connected with the inner hole through a lock bolt 32. The two pulleys 31 are respectively mounted at two ends of the headrest 3. A plurality of positioning holes 33 are formed in the end, inserted into the sleeve tube 11, of the headrest 3 at intervals. When the relative positions of the headrest 3 and the sleeve tube 11 are adjusted, the lock bolt 32 is matched with one of the plurality of positioning holes 33. The relative positions of the headrest 3 and the sleeve tube 11 can be adjusted to adapt to users of different heights.

A movable rod 4 is inserted into the other end of the sleeve tube 11. An end, away from the sleeve tube 11, of the movable rod 4 is fixedly connected with a foot hook frame 5. An end, inserted into the sleeve tube 11, of the movable rod 4 is fixedly connected with a rack 40. One end of the rack 40 is connected with one end of an elastic rope 6. The other end of the elastic rope 6 winds across the two pulleys 31 to be connected with a head protector 7. The end, inserted into the sleeve tube 11, of the movable rod 4 can also be directly connected with the elastic rope 6.

A support 12 is fixedly arranged on the outer side of the sleeve tube 11. A receding through hole 13 is formed in a position, corresponding to the support 12, of the outer side of the sleeve tube 11. A gear 8 is arranged on the support 12 and is engaged with the rack 40 through the receding through hole 13. One end of a manual swing rod 9 is hinged to the support 12. An active pawl 91 is hinged to the manual swing rod 9 and is close to the gear 8. One end of the active pawl 91 is matched with a toothed groove of the gear 8. A check pawl 92 is hinged to the support 12. A compression spring 93 is arranged between the check pawl 92 and the support 12. The compression spring 93 drives one end of the check pawl 92 to be matched with the toothed groove of the gear 8. The check pawl 92 prevents the gear from rotating reversely. Furthermore, one end of the manual swing rod 9 is fixedly connected with a U-shaped base 94. A first connecting pin 95 and a second connecting pin 96 are mounted on the support 12. The gear 8 and the U-shaped base 94 are pivoted on the first connecting pin 95. The gear 8 is located in the middle of the U-shaped base 94. The check pawl 92 is pivoted on the second connecting pin 96. A third connecting pin 97 is mounted on the U-shaped base 94. The active pawl 91 is pivoted on the third connecting pin 97 and is located in the middle of the U-shaped base 94. The third connecting pin 97 is sleeved with a torsion spring 98. One end of the torsion spring 98 leans against the U-shaped base 94. The other end of the torsion spring 98 presses against the active pawl 91 to enable one end of the active pawl 91 to be matched with the toothed groove of the gear 8. The first connecting pin 95, the second connecting pin 96, and the third connecting pin 97 are arranged in parallel.

The manual swing rod 9 can be swung to drive the gear 8 to rotate through the active pawl 91 and can also be pushed to drive the active pawl 91 and the check pawl 92 to be separated from the gear 8, and thus, the gear 8 can rotate freely.

Two sides of the sleeve tube 11 are each provided with a hinge base 14 which is close to the headrest 3. Each hinge base 14 is hinged to one end of a hand rest supporting rod 15. The other end of each hand rest supporting rod 15 is fixedly connected with a hand rest rod 151 which is sleeved with a protective jacket 10. The hand rest rods 151 are perpendicular to the hand rest supporting rods 15. Furthermore, the length of the hand rest supporting rods 15 can be adjusted. When the body stretcher is in use, the hand rest supporting rods 15 are approximately horizontal, and the hand rest rods 151 lean against the side face of the horizontal plate 2 through the protective jackets 10.

The foot hook frame 5 comprises a vertical rod 51 and two cross rods 52 fixedly connected to each of the two sides of the vertical rod 51. Each cross rod 52 is sleeved with a protective jacket 10. The lower portion of the vertical rod 51 is fixedly connected with one end of the movable rod 4. Wheels 53 are respectively mounted on two sides of the lower end of the vertical rod 51.

Furthermore, the vertical rod 51 comprises a lower vertical rod 511 and an upper vertical rod 512, wherein the lower vertical rod 511 is fixedly connected with one end of the movable rod 4, the upper vertical rod 512 is telescopically inserted into the lower vertical rod 511 and is fixedly connected with the lower vertical rod 511 through a lock bolt. Two sides of the lower vertical rod 511 are each fixedly connected with one cross rod 52. Two sides of the upper vertical rod 512 are each fixedly connected with one cross rod 52.

A foot support frame 20 is fixedly connected to the upper portion of a side, close to the foot hook frame 5, of the floor-standing frame 1 and is provided with a plurality of horizontal support rods 201. Two sides of each horizontal support rod 201 are each provided with one protective jacket 10. The two protective jackets 10 on each horizontal support rod 201 are connected through a clamping piece 202.

The movable rod 4 comprises a front movable rod 41 and a rear movable rod 42. The front movable rod 41 is inserted into the inner hole of the sleeve tube 11. The rack 40 is fixedly connected to the front movable rod 41. The rear movable rod 42 is telescopically inserted into the front movable rod 41. The front movable rod 41 and the rear movable rod 42 are fixedly connected through a lock bolt 43. In this way, the length of the whole movable rod 4 can be adjusted to adapt to users of different heights.

Figure 6:
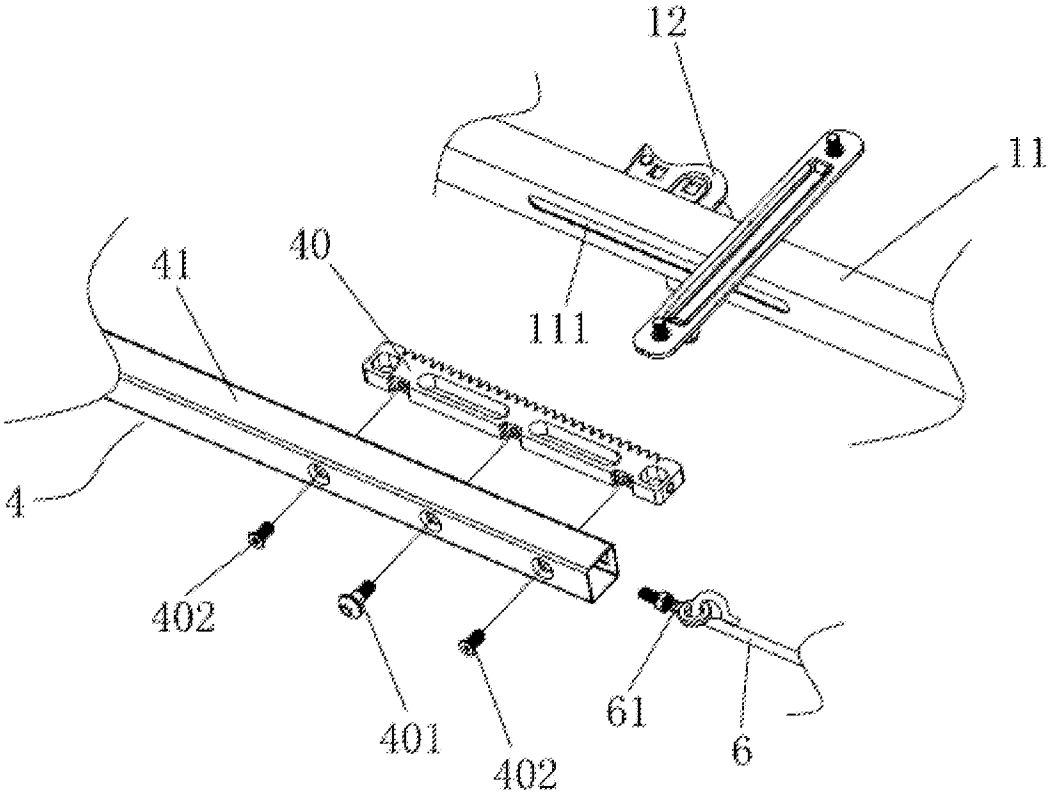
FIG. 6 is a partial exploded perspective view of a movable rod, a rack, a sleeve tube and an elastic rope.

Furthermore, as shown in FIG. 6, a limiting pin 401 is fixedly connected to the rack 40. A long strip-shaped limiting through hole 111 is formed in one side of the sleeve tube 11. The limiting pin 401 is matched with the limiting through hole 111 to restrain the moving position of the movable rod 4. The front movable rod 41 of the movable rod 4 is fixedly connected with the rack 40. The rack 40 and the front movable rod 41 are locked together through two screws 402. The elastic rope 6 is connected with one end of the rack 40 through a connecting bolt 61.

When the body stretcher in this embodiment is used, a user flatly lies on the horizontal plate 2 with the legs supported by the foot support frame 20, the two foot soles crooked on the foot hook frame 5 and the left and right hands leaning against the two hand rest rods 151 which are provided with the protective jackets 10, the two hand rest rods 151 lean towards the two sides of the horizontal plate 2, the user puts the head protector 7 on the head, grabs the manual swing rod 9 with the right hand and then repeatedly swings the manual swing rod 9, and then the manual swing rod 9 drives the gear 8 to clockwise rotate through the active pawl 91; afterwards, the gear 8 drives the rack 40, the movable rod 4 and the foot hook frame 5 to move to stretch the body; and the oppressed cervical vertebra and lumbar vertebra of the body can be stretched and exercised at the same time so as to be relaxed, and the body stretcher has a good rehabilitation effect on particular groups.

When the stretching time is up, the manual swing rod 9 can be pushed anticlockwise to a great extent to separate the active pawl 91 and check pawl 92 from the gear 8, then the gear 8 can rotate freely, and at this moment, the rack 40, the movable rod 4 and the foot hook frame 5 return to original positions under the effect of an elastic force from the elastic rope 6. The user can continue to stretch the body or take off the head protector 7 to stop exercising.

The user can also use the body stretcher in this embodiment to independently stretch and exercise the lumbar vertebra without wearing the head protector.

The above embodiment is only a preferred one of the invention. All equivalent variations made by those skilled in this field in terms of the claims should also fall within the protection scope of the invention.

What is claimed is:

1. A body stretcher, comprising a floor-standing frame, wherein a horizontal plate is fixedly connected to an upper surface of the floor-standing frame, a sleeve tube is arranged on the floor-standing frame, one end of the sleeve tube is connected with a headrest, a plurality of pulleys are mounted on the headrest, a movable rod is inserted into another end of the sleeve tube, an end, away from the sleeve tube, of the movable rod is fixedly connected with a foot hook frame, an end, inserted into the sleeve tube, of the movable rod is fixedly connected with a rack, and an elastic rope has an end connected with one end of the rack or the end, inserted into the sleeve tube, of the movable rod as well as an end winding across the plurality of pulleys to be connected with a head protector;

a support is fixedly arranged on an outer side of the sleeve tube, a receding through hole is formed in a position, corresponding to the support, of the outer side of the sleeve tube, a gear is mounted on the support and is engaged with the rack through the receding through hole, one end of a manual swing rod is hinged to the support, an active pawl is hinged to the manual swing rod and is close to the gear, one end of the active pawl is matched with a toothed groove of the gear, a check pawl is hinged to the support, a compression spring is mounted between the check pawl and the support and drives one end of the check pawl to be matched with the toothed groove of the gear, and the manual swing rod can be swung to drive the gear to rotate through the active pawl or can be pushed to drive the active pawl and the check pawl to be separated from the gear.

2. The body stretcher according to claim 1, wherein the headrest is in an L shape, and one end of the headrest is inserted in an inner hole in one end of the sleeve tube and is fixedly connected with the inner hole through a lock bolt; and the number of the pulleys is two, and the two pulleys are respectively mounted at two ends of the headrest.

3. The body stretcher according to claim 2, wherein a plurality of positioning holes are formed in the end, inserted into the sleeve tube, of the headrest at intervals, and when relative positions of the headrest and the sleeve tube are adjusted, the lock bolt is matched with one of the plurality of positioning holes.

4. The body stretcher according to claim 3, wherein a limiting pin is fixedly connected to the rack, a long strip-shaped limiting through hole is formed in one side of the sleeve tube, and the limiting pin is matched with the limiting through hole to restrain a moving position of the movable rod.

5. The body stretcher according to claim 2, wherein a limiting pin is fixedly connected to the rack, a long strip-shaped limiting through hole is formed in one side of the sleeve tube, and the limiting pin is matched with the limiting through hole to restrain a moving position of the movable rod.

6. The body stretcher according to claim 1, wherein the foot hook frame comprises a vertical rod and two cross rods fixedly connected to each of two sides of the vertical rod, each said cross rod is sleeved with a protective jacket, a lower portion of the vertical rod is fixedly connected with one end of the movable rod, and wheels are respectively mounted on two sides of a lower end of the vertical rod.

7. The body stretcher according to claim 6, wherein the vertical rod comprises a lower vertical rod and an upper vertical rod, the lower vertical rod is fixedly connected with one end of the movable rod, the upper vertical rod is telescopically inserted into the lower vertical rod and is fixedly connected with the lower vertical rod, two sides of the lower vertical rod are each fixedly connected with one said cross rod, and two sides of the upper vertical rod are each fixedly connected with one said cross rod.

8. The body stretcher according to claim 7, wherein a limiting pin is fixedly connected to the rack, a long strip-shaped limiting through hole is formed in one side of the sleeve tube, and the limiting pin is matched with the limiting through hole to restrain a moving position of the movable rod.

9. The body stretcher according to claim 6, wherein a limiting pin is fixedly connected to the rack, a long strip-shaped limiting through hole is formed in one side of the sleeve tube, and the limiting pin is matched with the limiting through hole to restrain a moving position of the movable rod.

10. The body stretcher according to claim 1, wherein two sides of the sleeve tube are each provided with a hinge base which is close to the headrest and is hinged to one end of a hand rest supporting rod, each said hand rest supporting rod has an end fixedly connected with a hand rest rod which is sleeved with a protective jacket, and the hand rest rods are perpendicular to the hand rest supporting rods.

11. The body stretcher according to claim 10, wherein a limiting pin is fixedly connected to the rack, a long strip-shaped limiting through hole is formed in one side of the sleeve tube, and the limiting pin is matched with the limiting through hole to restrain a moving position of the movable rod.

12. The body stretcher according to claim 1, wherein one end of the manual swing rod is fixedly connected with a U-shaped base, a first connecting pin and a second connecting pin are mounted on the support, the gear and the U-shaped base are pivoted on the first connecting pin, the gear is located in a middle of the U-shaped base, the check pawl is pivoted on the second connecting pin, a third connecting pin is mounted on the U-shaped base, the active pawl is pivoted on the third connecting pin and is located in the middle of the U-shaped base, the third connecting pin is sleeved with a torsion spring, the torsion spring has an end leaning against the U-shaped base as well as an end pressing against the active pawl to enable one end of the active pawl to be matched with the toothed groove of the gear, and the first connecting pin, the second connecting pin, and the third connecting pin are arranged in parallel.

13. The body stretcher according to claim 12, wherein a limiting pin is fixedly connected to the rack, a long strip-shaped limiting through hole is formed in one side of the sleeve tube, and the limiting pin is matched with the limiting through hole to restrain a moving position of the movable rod.

14. The body stretcher according to claim 1, wherein a foot support frame is fixedly connected to an upper portion of a side, close to the foot hook frame, of the floor-standing frame and is provided with a plurality of horizontal support rods, two sides of each said horizontal support rod are each provided with a protective jacket, and the two protective jackets on each said horizontal support rod are connected through a clamping piece.

15. The body stretcher according to claim 14, wherein a limiting pin is fixedly connected to the rack, a long strip-shaped limiting through hole is formed in one side of the sleeve tube, and the limiting pin is matched with the limiting through hole to restrain a moving position of the movable rod.

16. The body stretcher according to claim 1, wherein the movable rod comprises a front movable rod and a rear movable rod, the front movable rod is inserted into an inner hole of the sleeve tube, the rack is fixedly connected to the front movable rod, the rear movable rod is telescopically inserted into the front movable rod, and the front movable rod and the rear movable rod are fixedly connected through a lock bolt.

17. The body stretcher according to claim 16, wherein a limiting pin is fixedly connected to the rack, a long strip-shaped limiting through hole is formed in one side of the sleeve tube, and the limiting pin is matched with the limiting through hole to restrain a moving position of the movable rod.

18. The body stretcher according to claim 1, wherein a limiting pin is fixedly connected to the rack, a long strip-shaped limiting through hole is formed in one side of the sleeve tube, and the limiting pin is matched with the limiting through hole to restrain a moving position of the movable rod.

* * * * *